United States Patent [19]

David

[11] Patent Number: 4,561,656

[45] Date of Patent: Dec. 31, 1985

[54] BAR RIDING WHEEL

[76] Inventor: Constant V. David, 4952 Field St., San Diego, Calif. 92110

[21] Appl. No.: 625,740

[22] Filed: Jun. 28, 1984

[51] Int. Cl.[4] ..... A63B 67/14

[52] U.S. Cl. ..... 273/110; 446/170; 446/447

[58] Field of Search ..... 273/109, 110, 128 A, 273/DIG. 31; 446/170, 273, 444, 446, 447

[56] References Cited

U.S. PATENT DOCUMENTS 3,093,377 6/1963 Irwin ..... 273/109

*Primary Examiner*—Richard C. Pinkham
*Assistant Examiner*—Benjamin Layno

[57] ABSTRACT

A bar-riding wheel positioned on a single circular cross-sectional bar. One end of the bar is partly restrained but allows for a limited amount of swinging and/or rotating motions. The other end of the bar is held by the operator's hand, by means of a handle, and provides its actuating motion to the wheel by lifting the handle. The bar cross-section generally increases from its free end to its partly restrained end. The riding wheel exhibits a deeply shaped groove such that as the wheel rolls in the direction of the increasing cross section of the bar, the center of gravity of the wheel eventually rises, up to and beyond a point where the wheel riding position becomes unstable. A mobile counterweight system causes the instantaneous center of gravity of the riding wheel to be located below its instantaneous axis of rotation at all times. The object of the operation is to successfully manipulate the bar such that the riding wheel rolls as far as possible, in the unstable region without toppling over. The farther the wheel rolls along the unstable region, the greater the skill of the operator. Indicia on the bar provides an accurate measurement of the operator's skill.

19 Claims, 12 Drawing Figures

BAR RIDING WHEEL

BACKGROUND OF THE INVENTION

The present invention relates to a game of skill in dynamics involving the use of three basic movements of the hand: vertically, laterally and rotationally; and the means for measuring such skill. The game (or operation of the present invention) can also be used to help players improve their skill in coordinating these three basic hand movements and developing hand motion dexterity in a general way.

Many games based on manual dexterity have been developed and used in the past and are now still used. They sometimes involve the use of only one hand or both hands conjunctively. Usually, the means for playing the game does not provide for a gradual transitional phase between the easy and the impossible extremes in difficulty, within the range of its operation. It is also unusual for such games to establish a simple, automatic, visual and permanent record of the degree of skill achieved or of the player's score in a manner such that there can be no argument as to what that score was.

Efforts are continuously being made to develop new games which provide the flexibility of adaptation to the age or the degree of development of the players. For instance, it is desirable that, by changing or inverting simple elements entering into the composition of the game means, the degree and range of difficulty, and/or the amount and nature of skill required be made variable and adjustable to suit different classes of players. Further, it is desirable that an understanding of the working and operation of the game means be a contributing factor in helping the player's skill progress faster and farther.

In view of this background, the present invention provides those features that games of skill require and offers improvements in ways to develop and measure manual dexterity and coordination of the three basic types of motion of a hand.

SUMMARY OF THE INVENTION

Accordingly, it is a primary object of the present invention to provide a new and improved apparatus that combines the use of three basic types of movements which involve the hand, the wrist and the arm, either simultaneously or separately and in any combination thereof, in a coordinated manner.

It is another object of the present invention to provide an apparatus that can be used for the amusement of people of all ages and that can, at the same time, help them develop their manual dexterity and obtain a measure of their manual skill.

It is another object of the present invention to provide an amusement apparatus that can easily be changed and adjusted to vary the degree of difficulty of its operation to match the degree of skill of the operator.

It is another object of the present invention to provide an amusement apparatus that is simple and safe so that its operation and handling present no risks to the operator and those around him, when the apparatus is being used.

It is another object of the present invention to provide an amusement apparatus for measuring and recording, by simple and direct visual observation, the degree of skill displayed by the operator and as witnessed by those around him.

It is still another object of the present invention to provide an amusement apparatus that needs only one hand, either right or left, equally and indifferently, and that can thereby be used to develop and improve the manual dexterity and skill of the hand, the wrist and the arm, separately or together, and their motion coordination.

DETAILED DESCRIPTION OF THE INVENTION

Figures 1, 2, 3, 4, 5, 6, 7, 8, 9, 10, 11, 12:
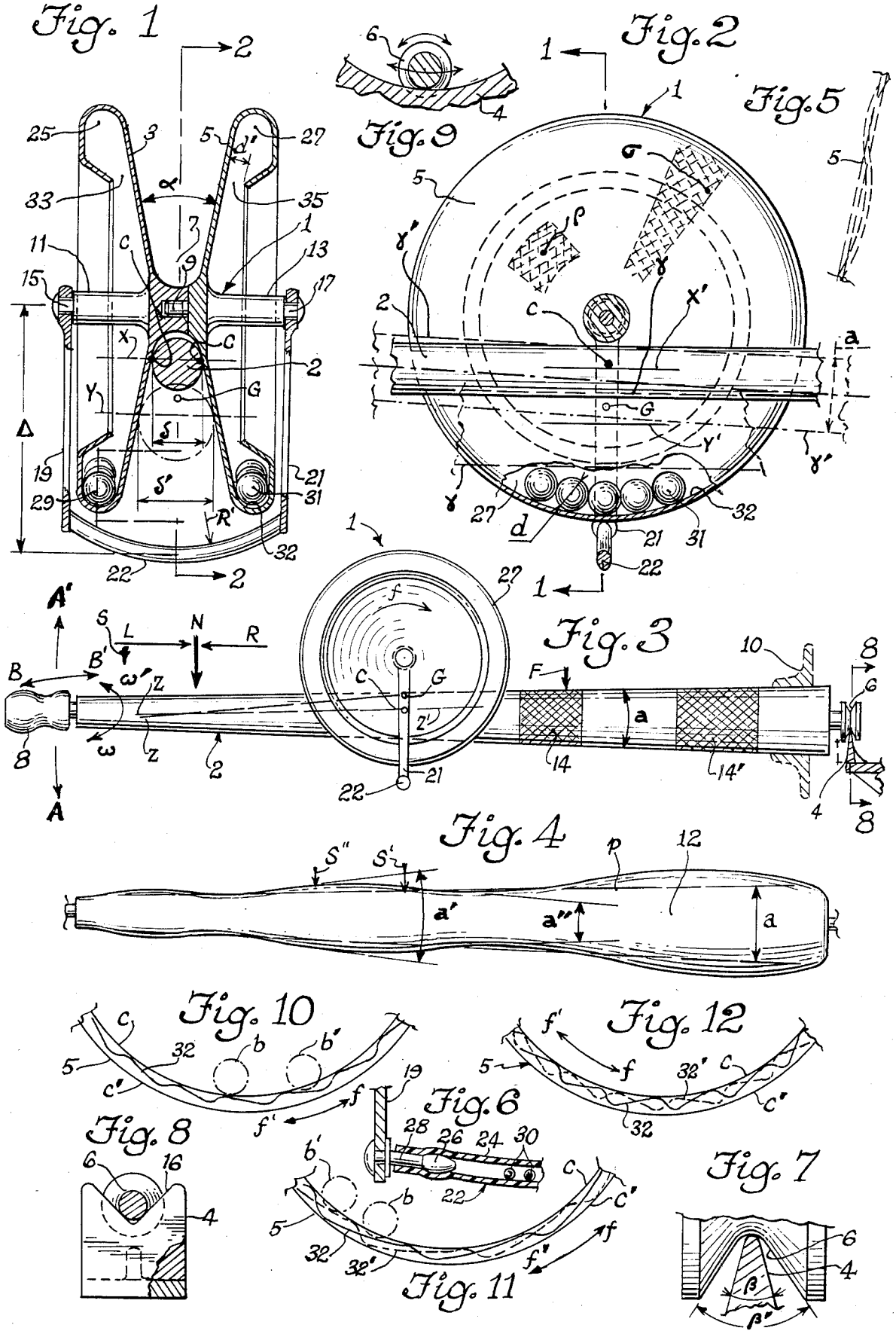
FIG. 1 is a midsectional side view of the wheel assembly taken along line 1—1 of FIG. 2.
FIG. 2 is a midsectional elevation view of the wheel assembly taken along line 2—2 of FIG. 1.
FIG. 3 is an elevation view of the wheel assembly shown straddling the riding bar.
FIG. 4 is an elevation view of another configuration of the riding bar.
FIG. 5 is a detailed partial sectional view of another configuration of the wheel assembly flange wall.
FIG. 6 is a detailed partial sectional view of the retaining hoop attachment.
FIG. 7 is a detailed partial sectional view of the riding bar end support shown in FIG. 3.
FIG. 8 is a partial detailed sectional view taken along line 8—8 of FIG. 3.
FIG. 9 is a partial detailed sectional view of another configuration of the riding bar support shown in FIG. 8.
FIG. 10 is a partial schematic diagram showing synchronized ball track configurations.
FIG. 11 is a partial schematic diagram showing ball track configurations out-of-phase.
FIG. 12 is a partial schematic diagram showing ball track configurations that are both inverted and out-of-phase.

Referring to FIGS. 1, 2 and 3, the illustrated embodiment of my apparatus shows a wheel assembly 1 straddling a riding bar 2. The apparatus also includes an end support 4 which serves to retain one end of riding bar 2 by means of groove 6 and which supports part of the apparatus weight. End support 4 can be clamped onto the edge of a table or a desk, onto the back of a chair, etc. . . , for instance. Such clamping means are not shown, being easily visualized. Riding bar 2 is equipped with a handle 8 located at its other end, and which is held and actuated by the apparatus operator. Near its supported end, riding bar 2 can be equipped with a stop flare 10 to prevent the wheel assembly from hitting end support 4 and/or its clamping means. Riding bar 2 has a circular cross-section and the diameter of this cross-section varies along the bar length either uniformly as shown in FIG. 3 or irregularly as shown by the riding bar 12 of FIG. 4, depending upon the degree of difficulty desired and the skill of the operator. Riding bars 2 and 12 exhibit indicia such as 14 and 14' on their surfaces to indicate specific bar stations.

The wheel assembly consists of two flanges 3 and 5 that form a deep V-shaped groove 7 between them. The two flanges are centered and held together by center stem and screw 9. The external face of each flange is equipped with protruding axles 11 and 13, long enough to protrude beyond the flange external sides. The end of each axle is fitted with retaining trunnions 15 and 17, on which arms 19 and 21 can freely rotate. The lower ends of arms 19 and 21 are joined by a rigid retaining hoop 22 solidly affixed to both arms. Flanges 3 and 5 form circular, semi-enclosed channels at their peripheries, first to give rigidity to their rims and, second, to provide track systems 25 and 27 in which a plurality of balls 29 and 31 are allowed to ride freely. Hoop 22 can be hollow and also contain freely rolling balls. Balls 29 and 31 have a diameter d slightly larger than the width d' of gaps 33 and 35, so that they cannot fall out of their respective tracks, but can easily be forced in or out manually. Instead of having smooth conical internal surfaces, flanges 3 and 5 may also have slightly undulating generally-conical surfaces, as illustrated in FIG. 5, the thus-formed waves or undulations being all concentric or helically wound around the generally-conical surfaces of the flanges. These undulations appear as waves along any generatrix of the flange conical surfaces, as shown in the partial cross-section of flange 5 wall (FIG. 5).

A hollow hoop 22 can be assembled onto its holding arms as depicted in FIG. 6, so that it can easily be disassembled and reassembled. Wall 24 of hoop 22 can be made of hard rubber or plastic-type material so that it can easily be slipped on and off the beaded end 26 of holding stem 28 affixed to arm 19, thereby restraining balls such as 30 which are free to roll back and forth inside hoop 22.

Referring to FIG. 7, it can easily be seen that the riding bar is restrained axially by the side faces of circular groove 6, but is free to swing vertically and laterally. FIG. 8 shows that groove 6 is prevented from moving laterally, being restrained by the sides of V-shaped notch 16. However, groove 6 is free to rotate inside notch 16. Another configuration of end support 4 is given in the illustration of FIG. 9, where notch 16 is replaced by a shallow curved track supporting the bottom of groove 6, whereby permitting a rolling motion of the end of riding bars 2 or 12 to take place.

Referring now to FIGS. 10–12, various arrangements of the ball tracks of flanges 3 and 5 are shown. Inner surfaces 32 (FIGS. 1 & 2) of tracks 25 and 27 can be shaped to be smooth, in which case balls 29 and 31 roll smoothly on their respective tracks. Inner surfaces 32 can also be shaped to exhibit a waviness such as that shown in FIG. 10, and which can be either symmetrical or asymmetrical. This waviness can be introduced by either shaping the inner surfaces of tracks 25 and 27 or forcing and locking an undulating spring-like thin strip against the smooth internal surfaces of tracks 25 and 27 (or of only one track for that matter). The waviness so created can be "synchronized", as shown in FIG. 10, for both flanges, or be "desynchronized" (out of phase), as shown in FIG. 11. In the case of FIG. 12, the inverted assymmetry of the two undulations is combined with the desynchronization of the wave patterns. The desired end result is of course an uneven, jittery behavior of balls 29 and 31, either in phase or out of phase, which is intended to induce a shaking of the wheel assembly when it is straddling the riding bar, as the wheel assembly moves along the riding bar.

OPERATION AND DISCUSSION

The operation of the present invention and the amusement derived therefrom is based on a basic and very well known physics principle: if the linear or punctual support of a body is located above its center of gravity, the body is in a stable position; if the linear or punctual support of a body is below its center of gravity, the body position is unstable. However, by moving said body or its support, the body can be made to remain in such unstable position. Without the counterweights provided by balls 29 and 31, retaining hoop 22 (and balls 26 inside the hoop, if they are used), the center of gravity (CG) of the wheel assembly would be located at the intersection of its lateral plane of symmetry and of its axis of symmetry, or axis of rotation. However, the counterweights displace the CG downward to point G of FIG. 1–3. Because all counterweights are free to rotate and are always located at their lowest possible stations, the wheel assembly CG appears to remain in the same position with respect to the instantaneous axis of rotation of the wheel assembly as it rolls (and therefore rotates) along on top of riding bar 2. Such CG is referred to as the instantaneous center of gravity, being the true CG at any and all instants, except that such instants are considered infinitesimally short compared to the wheel assembly motion velocity. In its vertical bar straddling position, the wheel assembly is supported by two contact points such as C and located on the horizontal line joining them, and which correspond to the tangency points common to the riding bar surface and the wheel assembly groove surfaces. If the diameter $\delta$ of the riding bar cross-section at the station where the wheel assembly rests is small enough, line X (C—C) is located above G (CG), the system is stable. But if the diameter of that riding bar cross-section is $\delta''$, for a given value of $\alpha$ and amount of counterwieghts, the new contact point line Y is located below G, the system is unstable. Assuming that $\delta$ increases gradually to $\delta''$, along the riding bar length, at some time during the wheel travel between such two bar cross-section stations, the wheel assembly passes, if remaining in the straddling position, from a stable condition to an unstable one.

Four factors then must now be considered: (1) the fact that the riding bar can be made to move laterally, (2) the inertia of the wheel assembly, (3) the friction between the wheel assembly surfaces and the riding bar surface, and (4) the fact that this friction both hampers the tumbling of the wheel assembly and can be used to impart a correcting moment to the wheel assembly by rotating the riding bar around its centerline, thus preventing the wheel assembly from toppling over. Also, the factor that causes the wheel assembly to move along the bar (riding it) is predicated, as it is for all rolling bodies, on the well known fact that such bodies, if free to move, tend to always lower their CG's, hence a vertical motion of the free end of the riding bar is needed to make the wheel assembly ride forward or backward. Assuming that the wheel assembly is first positioned near the handle end at the smallest bar cross-section diameter (left of station N in FIG. 3), a lifting of handle 8 in the vertical direction A' causes the wheel assembly to roll forward toward station N and to turn in the direction of arrow f. Station N corresponds to the location on the riding bar where line X of FIG. 1 passes through G (position of indifferent equilibrium). To keep the wheel moving forward, the lines of contacts such as X' and Y' shown in FIG. 2 (locii of the contact points C on the riding bar surface) must be slanting slightly downward in the right direction (condition of forward riding for the wheel assembly). If the riding bar were cylindrical and had a small diameter all the way (the condition shown by the solid line bar outline of FIG. 2), the wheel assembly could easily be made to ride the bar full length when line X' is tilted clockwise. If the riding bar were cylindrical but had a larger diameter $\delta''$ (bar contour lines $\gamma$), line Y' (then located below G) would also have to be tilted, but the wheel assembly would then soon tumble, unless the operator were skilled. But if the riding bar is conically shaped (small cone angle, as shown by contour $\gamma'$ of FIG. 2), the riding bar centerline must already be slightly tilted to keep its line X' horizontal. A slight additional tilting is needed to further tilt its contact line X'. One can now easily see how the condition of the increase of the riding bar diameter can be regarded as a series of short cylindrical sections instantaneously increasing in size. In this simple case of a slightly conical riding bar of cone angle a, the locus of the contact points C on the riding bar surface is a line Z' shown on FIG. 3. But the corresponding locus of the wheel assembly CG's in a line Z. At station N Z and Z' intersect. Left of N, lies the stable operation region (L); right of N, lies the unstable operation region (R). This describes the basic operation of the present invention and the challenge it offers: cause the wheel assembly to ride as far as possible into the unstable operation region without letting it topple over. All other variations of the basic operational mode of the present invention stem directly from it, with extra difficulties added and combined in various manners.

The simplest and most basic mode of operation of the present invention is depicted by the illustration of FIG. 3. For ease of understanding, it can be assumed that both balls 29 and 31, and hoop 22 (without balls 32 inside) behave and respond as one single counterweight which instantaneously always positions the wheel assembly CG at point G. It is also assumed that the allowable riding bar motions are those of a rigid bar articulated at its right side end on the equivalent of a ball joint articulation, and having an external surface that is a cone of revolution and with a uniform friction coefficient. It is also assumed that the internal surfaces of the wheel assembly are symmetrical cones of revolution and have a uniform friction coefficient. The wheel assembly is placed on the riding bar in the straddling position at a station such as S, left of N, with the operator holding handle 8. To start the wheel assembly rolling (riding), handle 8 must be moved up in direction A' so that line Z tilts clockwise (handle 8 higher than support 4, or riding bar centerline slanting downward toward support 4) so that the wheel assembly CG is prompted to move to the right. If the riding bar centerline were kept horizontal, the wheel assembly would tend to move to the left. Because of the additional parasitic friction introduced by the motion of balls 29 and 31 in their tracks and the rotation of hoop 22 arms around trunnions 15 and 17, the apparent rolling moment needed by the wheel assembly is larger than that which simple rolling "friction" of the wheel assembly without the counterweight would be. Because the parasitic friction is caused by sliding-type motions (balls against balls and trunnion journal bearings) it exhibits the typical characteristic of being higher before motion starts then after motion has started. That is the basic difficulty presented by the apparatus: the wheel assembly cannot be forced to move very slowly because the breakaway slant angle required of line Z is appreciably larger than the slant angle which would sustain a slow riding motion of the wheel assembly. Therefore, the operator is forced to "overlift" handle 8 to start the wheel assembly on its way, and then risks to "underlift" it to prevent the wheel assembly from riding too fast and running away.

Up to station N, the wheel assembly riding speed is not too critical. However, past station N, the wheel assembly riding speed becomes a critical factor. Because the wheel assembly then is prompted to topple over, the operator must constantly intervene in two ways: (1) by moving handle 8 laterally (directions B or B'), and (2) by rotating handle 8. The B–B' motion displaces the position of contact points C and counteracts the start of any tumbling motion of the wheel assembly, if done fast enough and to the right degree. The riding bar rotating motion, because of the sliding friction involved between the surfaces in contact, due to the inertia of the wheel assembly, causes a moment to be imposed laterally on the wheel assembly. Again, if done quickly, at the correct time and by the right amount, this induced motion can counteract any tumbling urge that the wheel assembly may experience at the time. The combination of these two actions is more than enough to keep the wheel assembly in its straddling position, when in motion in the unstable operation region. However, the operator must obviously be quick, observant and skilled. If such is the case, the operator is able to make the wheel assembly ride the bar until it reaches stop flare 10. But, if the wheel assembly topples over before that point (operator with lower skill), the wheel assembly comes to rest at a station such as F, where it tumbled, hanging down and held only by hoop 22. Riding bar 2 has indicia such as 14 on its surface, which by color or number indicate and give a measurement of the degree of skill displayed by the operator (player) for this ride. The operator can either start back at the starting end or place the wheel assembly back in a straddling position, at the station where it tumbled, and attempt to complete a full ride. The details and types of games that can be played, and the ways to keep and use the scores for such games, are not part of the present invention and need no further elaboration, except that they are numerous and can be made very complex if so desired.

Normally, in the case of the simplest version of the present invention discussed above, the total amount of vertical motion of handle 8 needed to control the working of the apparatus is rather small. Both the difficulty and degree of skill increase whenever larger amounts of vertical motion are required. The riding bar configuration shown in FIG. 4 does just that. A plurality of bulges of revolution are distributed along the length of the riding bar. FIG. 4 shows three such typical bulges, phantom line P represents the contour outline of the riding bar of FIG. 3, as a reference. These bulges vary the apparent instantaneous cone angle of the station cross-section on which the wheel assembly is "sitting". This angle varies from a maximum value a' to a minimum value a'' and that happens to be inverted (negative slant), which means that the riding bar centerline at a station such as S' must be tilted counterclockwise appreciably to slow down the wheel assembly once it has passed over the second bulge maximum diameter. Angle $\beta'$ of groove 6 must of course be larger than angle $\beta$ displayed by support 4 edge, by an amount equal or greater than the angular variation meeded for the total amount of vertical motion anticipated of the riding bar handle. If the wheel assembly is not slowed down when it begins its ride down the "negative" slope of the bulge, it will start riding the ascending portion of the next bulge at too high a velocity and its control becomes very difficult or even impossible. A larger number of shorter bulges produces the same results. The extent of the bulge swelling determines the degree of the difficulty thus created. The next step in increasing the difficulty and raising the degree of skill required is to give the riding bar centerline a slight bowing so that the bar rotation influences the lateral displacements of all stations of the riding bar, but in various degrees and directions depending upon where the bar bowing is located angularly at the time. The next degree of complexity can be introduced by letting retaining groove 6 ride along a slightly curved track of support 4, as illustrated in FIG. 9. Any rotation of the riding bar thus causes a small lateral displacement of its supported end which must either be anticipated or corrected for by the operator. In addition, if both ends of the riding bar are similarly equipped (handle 8+groove 6), the operator can elect to either ride the wheel assembly away from him or toward him. The basic difference between these two modes of operation resides in the fact that the same amount of handle motion generates a much different amount of motion of the wheel assembly, because of the leverage provided by the riding bar articulation layout. The sensitivity of the wheel assembly to any linear hand motion is greatest when the wheel assembly is most prone to tumble and which is also when the thick end of the riding bar is close to the operator. The compounding of these two difficulties is of much interest. Finally, the degree of influence of the rotation of the riding bar, or of the wheel assembly sliding friction when tumbling, on the straddling attitude of the wheel assembly control can be altered locally along the riding bar by changing the friction coefficient of its surface, from station to station or around its cross-section periphery. All these features can be combined in various riding bar and end support configurations in different manners so as to provide a gradually increase of difficulty presented by the apparatus.

Increasing degrees of difficulty and of the corollary level of required skill can also be introduced by "tampering" with the wheel assembly basic configuration. The various ways to interfere with the simplest operation of the basic wheel assembly configuration can be divided in three basic classes: (1) alter the wheel assembly CG position in a programmed or random manner, (2) cause the wheel assembly to receive mechanical impulses intended to trigger, initiate and facilitate tumbling, and (3) affect the wheel assembly response to the rotational control motion of the riding bar. The CG position of the wheel assembly can be raised by taking some balls out of tracks 25 and 27. If more are taken out of one track, the CG can then be made to move sideways and force the wheel assembly to ride in a lopsided fashion. If hollow hoop 22 is partially filled with balls 30, free to roll from one end of the hoop to the other, the lateral CG position can be made to vary. The manner in which this variation manifests itself depends upon the radius of curvature R′ of hoop 22. R′ can be made larger or smaller than the distance Δ from the lowest part of the hoop centerline to line segment C—C of FIG. 1, and around which the wheel assembly laterally turns when it starts tumbling. If R′ is much smaller than Δ, balls 30 do not move apreciably within hoop 22, whenever the wheel assembly tilts laterally. If R′ is much larger than Δ, a small tilting of the wheel assembly drives balls 30 to the end of hoop 22 on the same side the wheel assembly tilts, thereby displacing the CG in a direction tending to enhance the degree of unstability (negative feedback), thus raising the level of difficulty and skill required of the operator.

Tracks 25 and 27 ridden by balls 29 and 31 in FIG. 2 normally have smooth and even surfaces. This condition can easily be changed by either inserting modified tracks or shaping the inside walls of flanges 3 and 5 rims so that the surfaces on which said balls roll exhibit the waviness illustrated in FIG. 10 where line c represents the location of the crests of such waves, line c′ represents the outer surface of the rim and 32 shows the wavy surface then ridden by balls such as b and b′. In this configuration, the wave form is depicted assymmetrical, but it can be made symmetrical or with an inverted assymmetry. In FIG. 11, the wavy surfaces 32 and 32′, one for each wheel flange, are shown out-of-phase by half a wave length, but with the wave assymmetry being in the same direction for each of the two flanges. In FIG. 12, the waves of each flange are also shown out-of-phase, but also exhibiting an inverted assymmetry. The purpose of these waves, their shapes and their synchronization or lack of it is to cause an irregular, uneven, unpredictable and disturbing effect on ball b and b′ motions. Such effects result in continuous motions of the wheel assembly CG around its mean position. The wheel assembly thus steadily receives small mechanical impulses that trigger and accentuate the initiation and ease of tumbling of the wheel assembly, making it increasingly more difficult for the player to perform.

The internal conical surfaces of the V-groove formed by flanges 3 and 5 can be made or assembled in such a way that these surfaces are not symmetrical with respect to the plane of symmetry passing through section line 2—2 of FIG. 1. Such a lack of symmetry can be made to cause both an up-and-down motion of the wheel assembly CG (even when riding a cylindrical bar) and/or a wobbling movement of the wheel assembly around its mean instantaneous axis of rotation. This results in another dynamic effect intended to further disturb the wheel assembly precarious apparent stability, when located in the unstable region of operation of the apparatus. In addition, the surfaces of these flange walls can be made uneven and to exhibit a waviness such as that shown in FIG. 5. These undulations can either be concentric around the flange cone axis, located on only one flange wall, on both flange walls, in phase, out-of-phase, non-concentrically and wound along a conical helical path, and again in the same direction for each flange or in a reverse direction. In any and all of these combinations of waviness patterns, the end result is a disturbance of the position of the wheel assembly CG, away from the ideal position it would otherwise occupy, in a systematic, programmed and/or random manner depending upon the operation mode option selected by the player(s). Finally, the surface of these flanges in contact with the riding bar external surface can be made to exhibit different coefficients of friction, symmetrically or assymmetrically distributed for both flanges, depending upon an angular location such as $\sigma$ and/or a radial location such as $\rho$ of FIG. 2, and with which the riding bar eventually comes in contact during a full ride of the wheel assembly. Again, all these various wheel assembly features can be combined between themselves. Further, these wheel assembly feature combinations and those of the riding bar and end support can also be combined, in a graduated fashion intended to raise the degree of difficulty one small step at a time. The build up of all such steps can then cover the full range of operation: from very easy to impossible. The very easy operation corresponds to the case in which the wheel assembly CG never passes above the contact line C—C. The impossible operation corresponds to the case in which it is impossible, even for a highly skiled operator, to complete a full ride without at least one toppling over of the wheel assembly, the first time that such operator tries his hand at this most difficult combination of riding bar, end support and wheel assembly configurations.

Some of the changes in the features and charateristics of the three basic components of the apparatus (wheel assembly, riding bar and fixed end support) can be made by inverting the way one component relates to the others. Some other changes necessitate the disassembling and reassembling of the major parts of a basic component. To maximize the number of possible feature combinations and minimize the production cost of such an apparatus and the number of parts, feature changes should be made simple, effective and repeatable. Some typical cases are discussed below, as examples. The simplest feature change case is that of changing the riding bar surface coefficient of friction. FIG. 1 indicates that, under ideal conditions, lines X and Y are always located above the horizontal lines passing through the riding bar cross-section centers. Because, only a small amount of rotation of the riding bar is needed for effective control of the wheel assembly lateral riding attitude, smaller than $\pm\alpha/2$ in the case of a skilled player, the riding bar surface can be divided into two symmetrical regions separated by a plane passing through the riding bar centerline. Each half of the riding bar surface can be coated and/or finished to offer a choice between high and low coefficient of friction. In such an instance, four combinations of riding-bar-surface types of interactions with the wheel assembly become then available, just by turning the riding bar reference angular position $\pm 90°$: Low and High frictions, Low-High and High-Low frictions. In the last two combinations, the effects of the riding bar rotational input on the wheel assembly is roughly half-way between those of the first two cases, but assymmetrical and caused to be biased in either one of the two possible tumbling directions.

In the case of the flange surfaces, it is less expensive and more flexible to consider a surface that has an inherent high coefficient of friction, but that can easily be rendered very slick with a very light coat of slippery fluid that can be easily wiped off when the surface so coated is made to regain its original coefficient of friction. In such an instance, the degree and extent of the slicking up operation can be left up to the adversary player(s), thereby introducing another competitive aspect and challenge into any game and/or competitive opportunity offered by the present invention. In any event, the wheel assembly can also be turned around on the riding bar, so that the effects of any irregulatities in the wheel assembly CG motion, ahead or behind its ideal normal position, can be easily and simply reversed.

Finally, the changes of configuration of the retaining hoop must be kept simple and such that they always yield the same results, regardless of who installed the hoop. This is easily done by using a snap-on arrangement such as that depicted in FIG. 6. The end of tube 24 butts against the flange of beaded stem 28. The ends of tube 24 can also be shaped to make the fastening of bead 26 easy and reliable as is well known and state-of-the-art. The surfaces of the various hoop 22 configurations not only must have a high friction coefficient, but they also must be shaped to increase the drag forces developed by its sliding against any riding bar surface, whenever the wheel assembly is in its toppled over position. Such drag enhancement feature can have the form of small soft rubbery ridges, strung along the retaining hoop length on part of the periphery of the crosssections of the hoop that face the wheel assembly main body.

Finally, it should be pointed out that the present invention, by the very essence of its primary embodiment and, in addition, by the many alterations, and combinations thereof, that can be introduced, one at a time, offers the opportunity to be used for teaching, demonstrating and experimenting with many aspects of physics. Such aspects are: (1) equilibrium, (2) dynamics, (3) feedback principles, (4) friction, (5) symmetry, (6) synchronization, and (7) motion combination and coordination. The apparatus herein described and discussed thus covers an extensive range and depth of various fields of physics that stretch from high school to graduate college levels. This simple basic game of skill apparatus, when made more complex, can then also play a role in the scientific educational field. One could certainly attempt, as a graduate physics project, for instance, to design and build machines to operate successfully the most complex version of the apparatus.

The present invention thus has applications in several fields of human endeavors:

Amusement and competition

Dexterity and manual skill development and training

Science teaching

Equipment for laboratory demonstrations and experiments

Having thus described my invention, I now claim:

1. An apparatus adapted to be used by one hand of an operator and comprising:

a circular cross-section bar, held at one end by the operator's hand and supported, and partly restrained, at the other end by an articulation means;

a fixed support providing said partly restraining articulation means, thereby establishing a fixed set reference point for the bar movements, in any direction other than axial;

a handle located at the free end of said bar and providing the means to the operator for holding the bar free end, and for generating the bar free end movements;

a circular double-flanged V-grooved wheel assembly, the size of said groove being large enough to receive said bar and to allow said wheel to ride on the bar from one end to the other end; and means for varying the bar circular cross-section from one end of the bar to the other end.

2. An apparatus according to claim 1 and further comprising:

means for positioning the instantaneous center of gravity of the wheel assembly below the instantaneous axis of rotation of said wheel, regardless of said wheel angular position during its rotation, while riding on the bar;

means for preventing the wheel assembly from falling down and off the bar whenever the wheel tumbles from its riding position at any time during its travel from one end to the other end of the bar; and means for preventing the wheel assembly from moving along the bar further in either direction if the wheel has toppled over.

3. An apparatus according to claim 2 wherein the means for positioning the instantaneous center of gravity of the wheel assembly can be caused to act differently for each flange of said wheel, thereby providing a destabilizing action intended to create a triggering jittery effect that increases the difficulty, inherent to the apparatus operation, of keeping the wheel riding, in the unstable operating region of the bar, thereby raising the level of skill required of the operator.

4. An apparatus according to claim 3 wherein the means for adjusting the location of the instantaneous center of gravity of the wheel assembly can be adjusted by changing the amount of counterweight located in each wheel flange track, thereby altering the portion of the bar length for which the wheel assembly rides in an unstable fashion, for any given bar crosssection size distribution lengthwise, whereby the degree of difficulty inherent to a specific bar configuration can thus be changed and reprogrammed.

5. An apparatus according to claim 2 and further comprising:

means enabling disassembly of the wheel and easy changing of either one of the two flanges; and additional flanges having various flange configurations which, when substituted for either of said two flanges, alter the characteristics, behavior and response of said wheel assembly to any of the bar movements.

6. An apparatus according to claim 5 and further comprising:

means varying the diameter of the circular cross-section of the bar in a manner such that the instantaneous center of gravity of the wheel asembly is positioned below the line joining the two contact points between the bar and the wheel flanges, thereby causing the riding wheel to rest on and ride the bar in a stable manner, when the wheel assembly is located at a bar station where the bar cross-section is small, but said sitting and riding manner to become unstable whenever the bar cross-section, at the location where the wheel is manually made to move to, becomes large enough to lower said contact point line below the instantaneous center of gravity of the wheel assembly;

said bar cross-section variations of its diameter being gradual and having both a positive and negative gradient along the bar length depending upon the lengthwise location of said bar cross-section; and means for varying the nature and texture of the bar surface to alter and change its friction coefficient along the bar length, thereby changing the degree of influence that a rotation of the bar cross-section has on adjusting the attitude of the wheel assembly when resting on and riding the bar at said cross-section station.

7. An apparatus according to claim 6 and further comprising:

means for varying the nature and texture of the surfaces of the wheel groove walls to alter and change their friction coefficients radially and angularly, thereby changing the degree of influence that a rotation of the bar cross-section has on the operator's ability to adjust the attitude of the wheel assembly when resting on and riding the bar for that angular wheel position and location on the bar; and means for varying the local angle made by the common tangents to both the bar circular cross-section and the flange inner surfaces at their points of contact in a manner such that the wheel assembly path changes with both the angular position of the wheel assembly and its station location on the bar.

8. An apparatus according to claim 7 wherein the bar has indicia shown on its surface in a manner such that the location where the wheel assembly tumbles and comes to rest in its toppled position can easily be identified and recorded by any observer, after the wheel assembly is left hanging down and held only by its retaining hoop.

9. An apparatus according to claim 8 wherein the retaining hoop of the wheel assembly has a surface that exhibits a high friction coefficient, thereby preventing the wheel assembly from sliding past the location where it toppled over and came to rest, thereby causing said location to become easily identifiable; and wherein the hoop is hollow and shaped to contain a mobile counterweight that affects the wheel stability as needed.

10. An apparatus according to claim 9 wherein the bar articulation means on the fixed support permits the manually operated handle of the bar to move vertically, laterally and rotationally simultaneously and separately, and in any combinations and degrees thereof, as the operator's hand so elects.

11. An apparatus according to claim 10 wherein the motions, and their nature and degree, imposed by the operator's hand on the bar handle provide the operator with the means for causing the wheel assembly to move along the bar lengthwise, in both directions;

for compensating for any physical urge that the wheel may have to start tumbling when it has reached a region of inherent instablity on the bar; and for causing the wheel assembly to reach the station of highest instability on the bar, and which becomes the measure of the operator's skill.

12. An apparatus according to claim 11 wherein the bar centerline is slightly bowed, whereby a rotation of the bar, while the wheel is in the riding position, induces a combined lateral and vertical motion of the wheel, thereby making the control of the wheel attitude more difficult and thus raising the level of skill required of the operator.

13. An apparatus according to claim 12 wherein the riding wheel is positionable on the bar in a manner such that the wheel assembly can be caused to rotate in a direction selected out of two possible directions when rolling on the bar from the handle end to its articulated end, according to the manner in which the wheel assembly is positioned on the bar by the operator.

14. An apparatus according to claim 13 wherein both ends of the bar are equipped with a handle and an anchoring groove, thereby making it possible to cause the wheel assembly to ride the bar away from the operator, for one bar position, and toward the operator when the other end of the bar is anchored onto the fixed support, whereby an additional complexity and higher degree of difficulty, and skill required, can thus be introduced and be made part of the game.

15. An apparatus according to claim 1 wherein the articulated restrained end of the bar is prevented from moving laterally and is only permitted to rotate freely, and is fully restrained axially by its fixed end support.

16. An apparatus according to claim 1 wherein the articulated and end of the bar is free to roll laterally, to rotate freely, but is fully restrained axially by its end fixed support.

17. An apparatus according to claim 16 wherein the end of the bar near its fixed support flares out, thereby providing a safe stop for the wheel assembly at the end of its maximum travel.

18. An apparatus according to claim 17 wherein means is provided for opening the retaining hoop simply and reliably, thereby easing the wheel disassembly and its installation on the bar.

19. A method of measuring, developing and improving the manual dexterity and skill of an operator by means of a circular wheel assembly cooperating with a bar having a circular cross-section and on which it rides, said bar being held at one of its two ends by the operator with a rotatable handle which can be moved simultaneously vertically and laterally, the other end of said bar being supported by articulation means which restrains the axial motion of the bar, said wheel assembly having two flanges shaped to form a V-shaped circular groove used to make the wheel assembly straddle the bar in the riding mode and having mobile means for positioning its instantaneous center of gravity with respect to a line formed by joining the two contact points between the bar and the wheel assembly flanges, said bar cross-sections varying according to their lengthwise locations on the bar in a manner such that the straddling action of the wheel assembly is caused to be either stable or unstable depending on the size of the bar cross-section where the wheel assembly happens to be located at that time, comprising the steps of:

placing the wheel assembly in a straddling position on the bar where said position is stable;

vertically moving the bar handle with the hand which the operator selects to use, in a direction such that the hand motion will cause the wheel assembly to roll on the bar toward a position characterized by a lower degree of straddling stability and even further on by instability, as a first form of motion;

simultaneously, as needed, laterally moving the handle so as to prevent the toppling over of the wheel assembly during its rolling motion as its position becomes less stable, as a second form of motion;

concurrently, as deemed necessary by the operator, rotating the bar around its longitudinal axis in a direction such that an incipient toppling movement of the wheel assembly can be stopped and then corrected, as a result of the friction existing between the bar and the wheel flanges at their contact points, as a third form of motion;

attempting to bring the wheel assembly to a location on the bar where the wheel assembly reaches a position of instability, while preventing it from toppling over using any combination of the three forms of motions above described as deemed most appropriate and effective by the operator;

further attempting in the above described manner to bring the wheel assembly to a position on the bar which corresponds to the highest degree of instability attainable; and detecting and recording the location on the bar where the toppling over of the wheel assembly occurred.

* * * * *